United States Patent [19]

Sauget

[11] Patent Number: 4,525,154

[45] Date of Patent: Jun. 25, 1985

[54] FOIL TRANSFER DEVICE FOR AN INSTALLATION FOR MANUFACTURING HOLLOW TRUNCATED CONE SHAPED ARTICLES AND IN PARTICULAR WINE BOTTLE CAPS

[75] Inventor: Bernard Sauget, Plaisir, France

[73] Assignee: Construction-Gerance-Exploitation "CONGEX", Les Clayes Sous Bois, France

[21] Appl. No.: 548,835

[22] Filed: Nov. 4, 1983

[30] Foreign Application Priority Data

Nov. 10, 1982 [FR] France ..... 82 18932

[51] Int. Cl.[3] ..... B31B 49/02

[52] U.S. Cl. ..... 493/154; 53/139.3; 493/296; 493/386

[58] Field of Search ..... 493/111, 112, 386, 388, 493/296, 155; 53/291-295, 139.3, 582, 587, 588, 589

[56] References Cited

U.S. PATENT DOCUMENTS

| | | | |
|---|---|---|---|
| 1,283,966 | 11/1918 | Taylor | 493/296 |
| 1,953,917 | 4/1934 | Barbieri | 493/155 |
| 2,186,073 | 1/1940 | Johnson | 493/155 |
| 2,674,929 | 4/1954 | Witlkuhns | 493/155 |
| 2,826,884 | 3/1958 | Eddison | 53/295 |
| 3,407,564 | 10/1968 | Randrup | 493/296 |
| 4,013,496 | 3/1977 | Amberg | 53/291 |
| 4,238,267 | 12/1980 | Konstantin | 53/292 |
| 4,452,596 | 6/1984 | Claiss | 493/107 |

FOREIGN PATENT DOCUMENTS

| | | | |
|---|---|---|---|
| 1456093 | 11/1976 | United Kingdom | 53/292 |

*Primary Examiner*—Leon Gilden
*Attorney, Agent, or Firm*—Walter C. Farley

[57] ABSTRACT

The invention provides a transfer device comprising at least one gripping member (19) mounted for pivoting about a first shaft (19*a*), on a support (16) mounted for rotation about a second shaft (16*a*). The support (16) rotates through three angular steps per revolution to place the gripping member (19) in three successive positions (P1,P2,P3), in which it is respectively opposite the posts for precutting, finishing cutting and rolling of the foils. An orientation means (24) associated with a means (57) for adjusting the starting orientation of the gripping members, further allows each of these latter to be pivoted between its first (P1) and second (P2) positions, through an angle depending on the conicity to be given to the finished articles, and maintaining it as far as its third position (P3) in the orientation which it has in its second position (P2).

9 Claims, 9 Drawing Figures

FOIL TRANSFER DEVICE FOR AN INSTALLATION FOR MANUFACTURING HOLLOW TRUNCATED CONE SHAPED ARTICLES AND IN PARTICULAR WINE BOTTLE CAPS

The present invention relates to an installation for manufacturing, from flexible foils, hollow truncated cone shaped articles and in particular caps for wine bottles with a widened neck, this installation comprising a pre-cutting out post where foil blanks are cut out in succession from a continuous strip, a finishing cutting out post where foils having the final required dimensions are produced from these blanks, a rolling up post where each of these foils is rolled up on a respective truncated cone shaped sleeve of a device for shaping hollow articles, adapted to be driven with a stepped rotary movement and a transfer device which moves the foil blanks one by one between the pre-cutting out post and the finishing cutting out post, then brings the foils from this latter to the rolling up post.

Such installations are essentially used for manufacturing truncated cone shaped caps made from aluminum foil, some of which cover the cork of certain wine bottles with a widened neck, and in particular champagne bottles.

The successive steps for manufacturing a cap of this type are illustrated in the accompanying FIGS. 2*a* to 2*d*.

FIG. 2*a* shows a foil blank produced in the pre-cutting out post. This blank has two edges a and b in the form of arcs of a circle, which are defined by the cutting line produced by the knife in the pre-cutting out post and two rectilinear edges c and d corresponding to the lateral edges of the continuous strip from which the blank is cut out.

The cutting knife in the finishing cutting out post is then operated to cut the blank along the rectilinear cutting line e (see FIG. 2*b*) and produce an aluminum foil, such as shown in FIG. 2*c*, which has the dimensions required for being used for manufacturing the cap which, at the end of manufacture, has the shape shown in FIG. 2*d*.

The aesthetical quality of the finished caps, which is an objective of prime importance which such manufacture should allow to be attained, is determined by the quality of the rolling up of the aluminum foils on the sleeves of the shaping device. Now, this rolling up can only be correct if, on the one hand, the foils are accurately cut out to the required dimensions and, on the other hand, if the front edge f of each of the foils (see FIG. 2*c*), defined by the cutting line e, is exactly applied along a generatrix of the rolling up sleeve.

These two conditions depend respectively on the orientation of the cutting line e with respect to the edges of the blank, and on that of the front edge of the foil with respect to the rolling sleeve. Consequently, when it is desired to change the conicity of the finished cap, the transfer device must be able to modify the orientation of the foil blank, with respect to the knife in the finishing cutting out post, without altering that of the front edge of the foil, defined by this knife, with respect to the rolling up sleeve.

Now, known transfer devices, which are formed essentially by pneumatic operation means, of the suction cup type, do not have a structure allowing them to attain such objectives.

The present invention proposes overcoming these disadvantages and, for this, it provides an installation of the above specified type which is characterized in that the transfer device comprises at least one gripping member mounted for pivoting about a first axis on a support which is itself adapted to be moved, in synchronism with the stepped rotation of the shaping device, through three successive angular steps per revolution about a second axis with respect to which the pre-cutting out, finishing cutting out and rolling up posts of the installation are centered, so that between the three angular rotations of its support, the gripping member is successively immobilized in a first position in which it grasps a foil blank opposite the pre-cutting out post, a second position in which it presents this blank under the finishing cutting out post and a third position in which it releases the cut out foil opposite the rolling up post, the transfer device further comprising a mechanism for orientating the gripping member for causing it to pivot through a pre-set angle about said first axis, between its first and its second positions, then holding it as far as its third position in the orientation which it has in its second position and placing it again in its first position in its starting orientation, and means for adjusting the starting orientation of the gripping member depending on the conicity to be given to the finished hollow articles.

In this transfer device, modification of the starting orientation of the gripping members allows their pivoting angle to be adjusted for adjusting the orientation of the foil blanks under the cutting knife of the finishing cutting out post depending on the conicity to be given to the finished articles and this without modification of the orientation, with respect to the rolling up sleeve, of the gripping members and so of the front edge of the foils which they carry.

Advantageously, the transfer device comprises three gripping members centered about the second axis and angularly equidistant from each other, their support being formed by a rotatary table mounted for rotation about the second axis and movable angularly by three successive steps of 120° per revolution, each correspoonding to a rotational step of the shaping device.

The purpose of this arrangement is to increase the rate of transfer of the foils and, thus, the productivity of the installation.

According to a preferred embodiment of the invention, the orientation mechanism comprises two fixed superimposed cams along one or other of which each gripping member is, during rotation of the rotatary table, guided by a set of two rollers, the position of one of which is adjustable, these two cams combining their actions so as to cause each gripping member to pivot through said preset angle, in one direction between its first and second positions and in the other direction between its third and first positions and for maintaining it in a constant orientation between its second and its third positions.

More precisely, the two cams are firmly fixed to the rotary shaft of the rotary table, one of these cams being circular and centered about this shaft whereas the second one has a guide edge which moves away from this shaft over a first section covering the path of each gripping member between its third and its first positions and which draws near thereto over a second section which covers this path between the first and second positions of the gripping member; moreover, each gripping member has a first fixed roller for cooperating with the first cam and a second roller adjustable in position for cooperating with the second cam and situated between this latter and the first roller, the second roller rolling over a part at least of the first and second guide sections of the second cam for causing the corresponding gripping member to pivot through said preset angle in one direction and in the other whereas the first roller bears against the first cam as soon as the second roller is disengaged from the second cam, for maintaining the gripping member in a constant orientation, the means for adjusting the starting orientation of the gripping member being formed by a member for positioning each of the second rollers.

Preferably, said positioning member is formed by an endless screw having a knurled wheel which guides the second roller inside an aperture formed in a lateral extension of a support plate supporting the gripping member and which is associated with a clamping screw for immobilizing the second roller in any position along this aperture.

According to another feature of the invention, each gripping member is formed by a nipper which opens outwardly of the table and which, under the control of an actuating mechanism, is closed shortly after being immobilized in its first position, and is only opened once stopped in the third position.

Furthermore, each nipper comprises two jaws both hinged to a nipper body and connected together, on one side of their hinge pins, by a hinged connection forming a deformable parallelogram and, on the other side, by two paired return springs, said actuating mechanism connected to the hinged connection for placing it, under the action of an opening actuator, in its inoperative position in which the two jaws are spaced apart from each other and, under the action of a closing actuator, freeing it from this inoperative position and allowing the springs to urge the two jaws against each other.

In comparison with the pneumatic gripping members of known transfer devices, these nippers provide more reliable gripping and transfer of the foils.

One embodiment of the present invention will be described hereafter by way of non limiting example with reference to the accompanying drawings in which:

FIG. 1 is a partial schematical top view of an installation in accordance with the invention for producing wine bottle caps;

FIGS. *2a* to *2d* are views illustrating the progressive transformation of an aluminum foil blank into a cap, between the different work posts of this installation;

Figure 1:
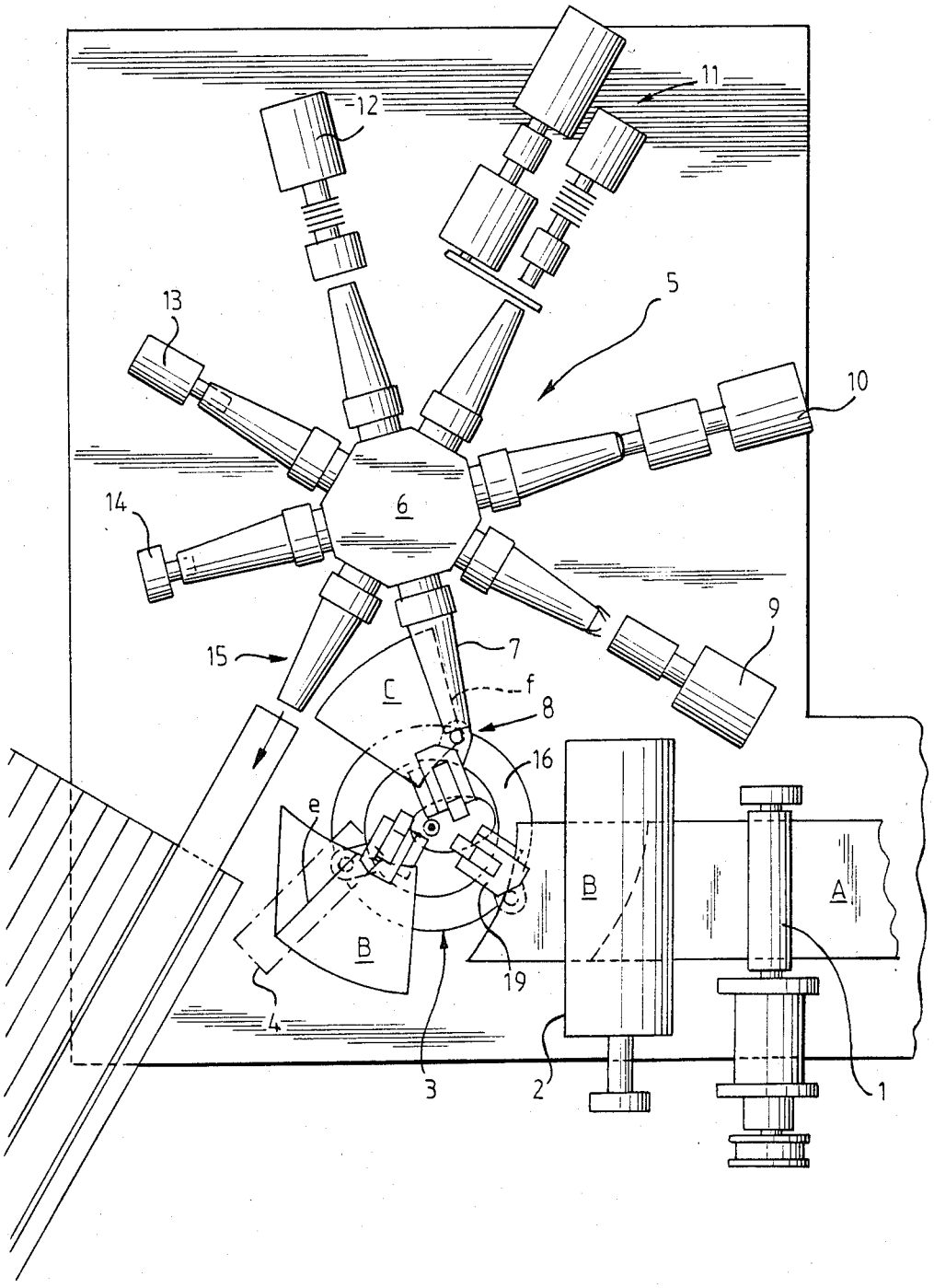
Figure 2B:
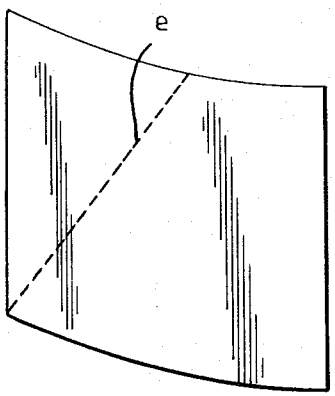
Figure 2D:
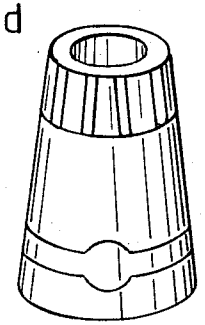
Figure 2A:
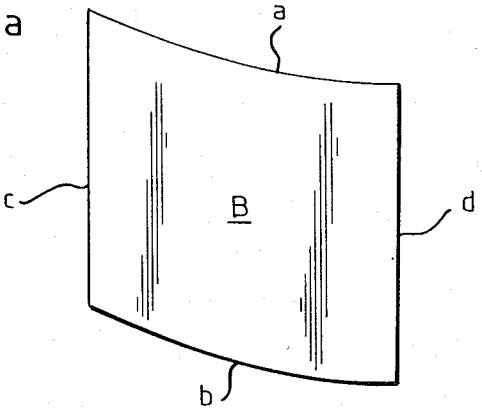
Figure 2C:
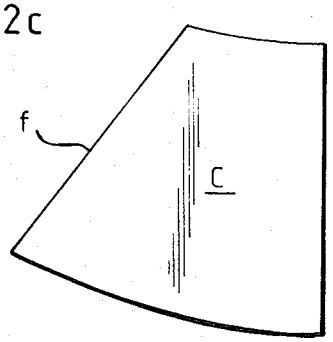

The installation shown in FIG. 1 is designed for manufacturing slightly truncated cone shaped caps with which certain wine bottles with a widened neck are covered such as champagne bottles. These caps are formed from fine aluminum foils or a similar material, which in this installation, are in a way know per se, produced in the following way.

An aluminum strip A is fed continuously from a spool, not shown, by means of a motor driven feed roller, which cooperates with a freely rotating roller (not visible) for feeding the strip. The tractive force which these rollers must exert on strip A is reduced to a great extent by the presence of a compensating idler (not visible in FIG. 1) in the path of the strip.

Over the whole length of its downwardly turned face, the aluminum strip A carries a succession of identical pre-printed patterns, each formed by inscriptions and designs which will be visible on the finished caps. Between the spool and the feed roller 1, strip A may further undergo, during winding off, a succession of preparatory operations such as the formation of an embossed pattern, or the formation, at even intervals, of perforation lines followed by the fitting of a tear tab along each of these lines.

Downstream of the feed roller 1, strip A passes through a pre-cutting out post 2 where it is periodically severed between two successive pre-printed patterns, along a cutting line in the form of an arc of a circle. Thus, aluminum foil blanks B, such as the one shown in FIG. *2a*, are cut out in succession from strip A.

These blanks B are then taken up one by one by a transfer device 3 which, in a first step, moves them in a horizontal plane for positioning them in turn under the cutting knife of a finishing cutting out post 4 where they are severed along a rectilinear cutting line e (see FIG. *2b*). This cutting line, suitably orientated, defines in each of blanks B an aluminum foil C (FIG. *2c*) having the exact dimensions and shape required for manufacturing the desired type of truncated cone shaped cap.

These caps are formed by means of a shaping device 5. This latter comprises a roundabout 6 supporting eight removable truncated cone shaped sleeves 7 which have a degree of conicity corresponding to that of the caps to be produced. Each sleeve 7 is first of all immobilized opposite a rolling up post 8 where the foils C, coming from the finishing cutting out post, are brought in turn by the transfer device 3. Foil C which is in this rolling up post 8 is rolled up in a way known per se about the sleeve 7, after its front edge f, defined by the cutting line e, has been applied along a generatrix of this sleeve. Sleeve 7 carrying foil C is then successively brought opposite seven other work posts, namely a pre-shaping post 9, a shaping post 10, a fiscal stamp application post 11, a bonding post 12, a fluting post 13, a stacking notch formation post 14, and a post 15 for ejecting the finished caps.

Figure 3:
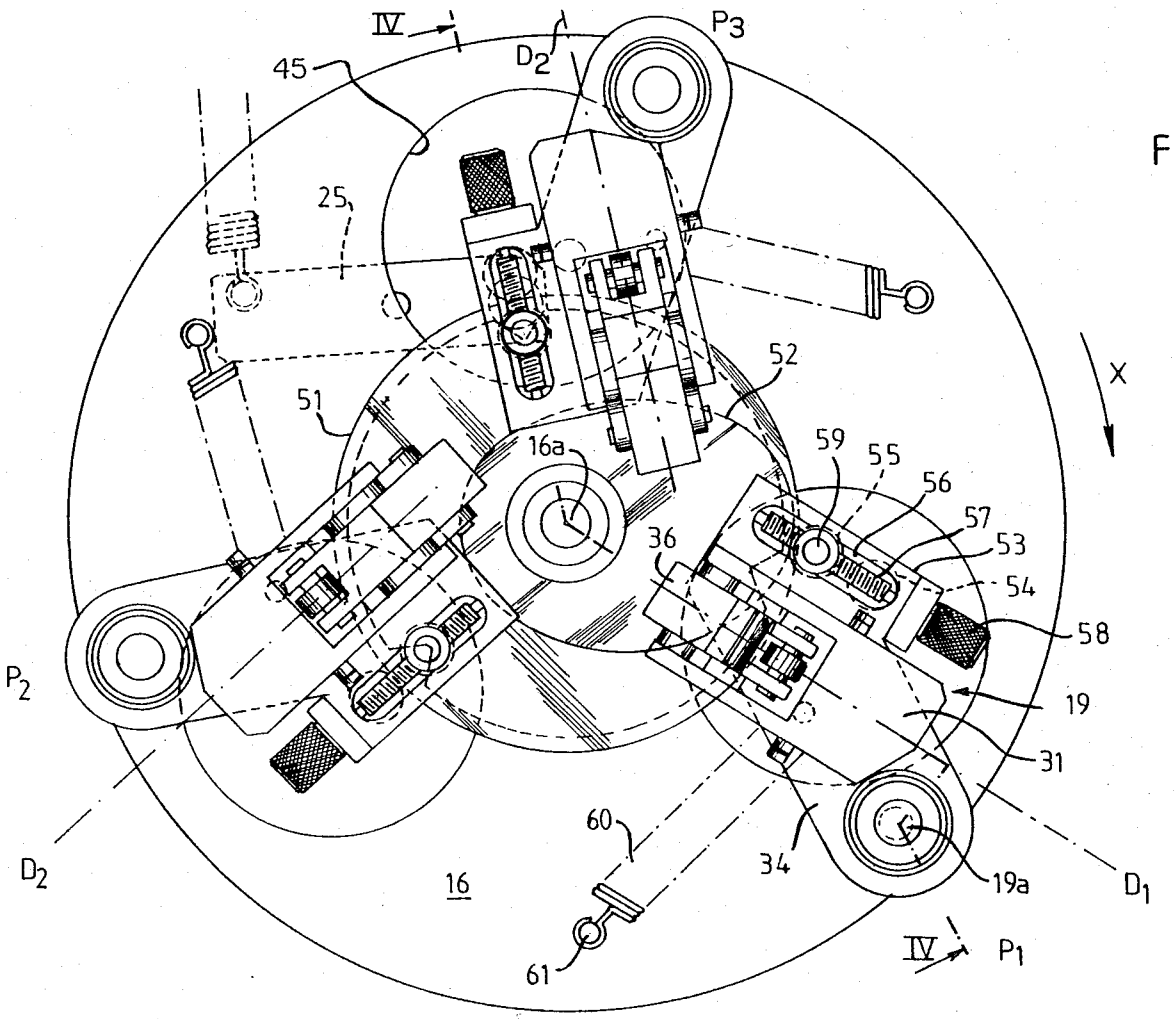
FIG. 3 is an enlarged top view of the foil transfer device equipping this installation.

The transfer device 3 which forms precisely the subject matter of the present invention will now be described with reference to FIGS. 3 and 4.

As can be seen, this transfer device comprises a rotary table 16 mounted for rotation about a fixed vertical shaft 16*a* with respect to which the pre-cutting out 2, finishing cutting out 4 and rolling up 8 posts are centered (see FIG. 1). Shaft 16*a* is firmly fixed to a base 17 whereas table 16 is supported by a sleeve 18 maintained rotating about shaft 16*a*.

The rotary table 16 carries on its periphery three identical gripping members 19 which are mounted for pivoting, in a horizontal plane, about fixed shafts 19*a*. The gripping members 19 are centered about shaft 16*a* and are angularly equidistant from each other.

The rotary table 16 is connected to a drive means for rotating it, about shaft 16*a* and in a clockwise direction, in three successive angular steps of 120° per revolution. This stepped rotational movement of table 16 is synchronized with that of the roundabout 6 of the shaping device 5, so that each time that this latter rotates through 45°, the rotary table 16 undergoes an angular rotation of 120°. This synchronization of the rotational movements of table 16 and roundabout 6 is obtained by means of a toothed belt 22 which extends about a grooved ring gear 23 fixed to sleeve 18 and which is driven by the motor of the roundabout 6, through an appropriate step-down means not shown.

Between each of the angular rotations of the rotary table 16, each gripping member 9 is successively immobilized, as shown in FIG. 1, in a first position P1 in which it is opposite the outlet of the pre-cutting out post 2 for grasping a foil blank B, then in a second position P2 in which it is positioned opposite the finishing cutting out post 4 for presenting this blank B under the cutting knife of this latter and finally in a third position P3 in which it is positioned in the rolling up post 8 opposite an empty sleeve 7, for applying the front edge f of foil C along a generatrix of this latter before releasing it.

During their transfer, blanks B and foils C slide over a horizontal metal sheet, not shown, which borders the rotary table 16 between the pre-cutting out 4 and rolling up 8 posts.

The transfer device 3 further comprises an orientation mechanism 24 which is designed for causing each gripping member 19 to pivot about its respective shaft 19*a*, between its first position P1 and its second position P2, then for holding it as far as its third position P3 in the orientation which it has in its second position P2 and for finally placing it again in its first position P1 in its starting orientation. The starting orientation of each gripping member is preset, by means which will be described further on, depending on the conicity to be given to the finished caps.

Thus, with this orientation mechanism 24, the gripping members 19 may position blanks B with respect to the cutting knife of the finishing cutting out post 4 in the orientation which is suitable for foils C to be cut out to the exact dimensions required for the conicity to be given to the caps and then for the front edge f of these foils, defined by this cutting out operation, to be applied exactly along a generatrix of the sleeve 7, these conditions being absolutely necessary for the rolling up of foils C on the sleeves to take place correctly and for the finished caps to have a perfect aesthetic appearance.

Figure 6:
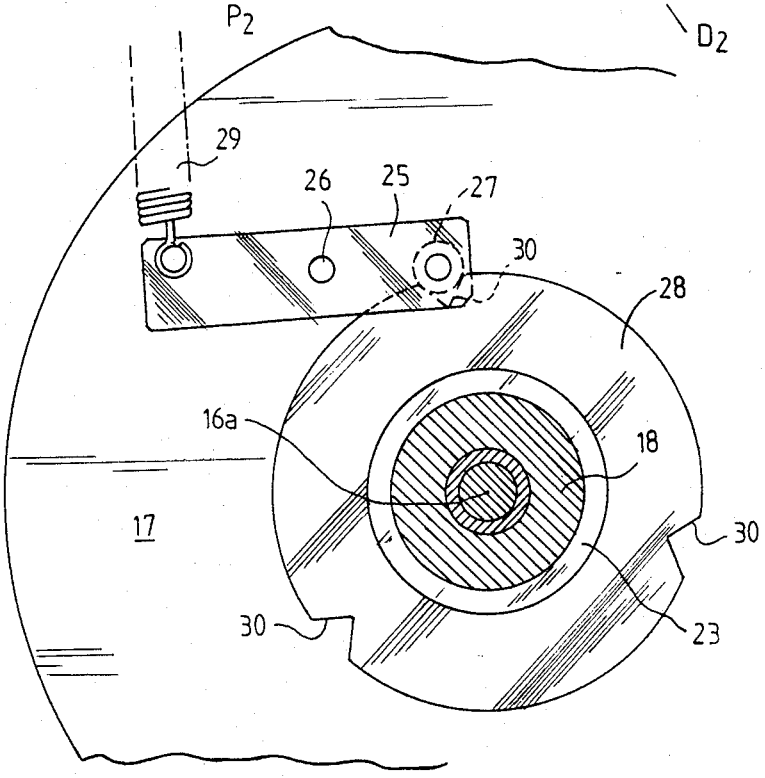
FIG. 6 is a sectional view along line VI—VI of FIG. 4.

For immobilizing the rotary table 16 instantaneously between each of its angular rotations, a stop mechanism is further provided as shown in FIG. 6. This stop mechanism is formed by a detent 25 mounted for rotation on base 17 of table 16 about a vertical pin 26. At one of its ends, detent 25 supports an idling roller 27 which is applied against a disk 28 supported by sleeve 18, under the action of a spring 29 causing the detent to pivot, and which is engaged, each time the table stops, in a notch 30 formed every 120° on the periphery of disk 28.

Coming back to FIG. 4, the structure of one of the gripping members 19 will now be described which is identical in all points to that of the other two.

As can be seen, this gripping member is formed by a nipper which opens outwardly of the rotary table and which are formed by an upper jaw 31 supporting a metal clamping heel 31*a* and a lower jaw 32 having a rubber clamping heel 32*a*. The two jaws 31 and 32 are hinged by means of two shafts 31*b* and 32*b* to a nipper body 33 which rests on a support plate 34.

The support plate 34 is mounted for pivoting about shaft 19*a*, through a bearing 35, shaft 19*a* being fixed in a vertical position on the edge of the rotary table 16.

At their rear ends, the two jaws 31 and 32 are joined together by a hinged connection 36 of the deformable parallelogram type, housed in two indentations 37, 38 formed in the two jaws. On the other side of their hinge pins 31*b* and 32*b*, they are further connected together by two paired return springs 39 which urge them against each other. Opening and closing of nippers 19 are provided respectively by a first and second actuator with vertical rod 40 and 41, which are fixed to the base 17 of table 16 and act on the nippers through an actuating mechanism 42.

Figure 4:
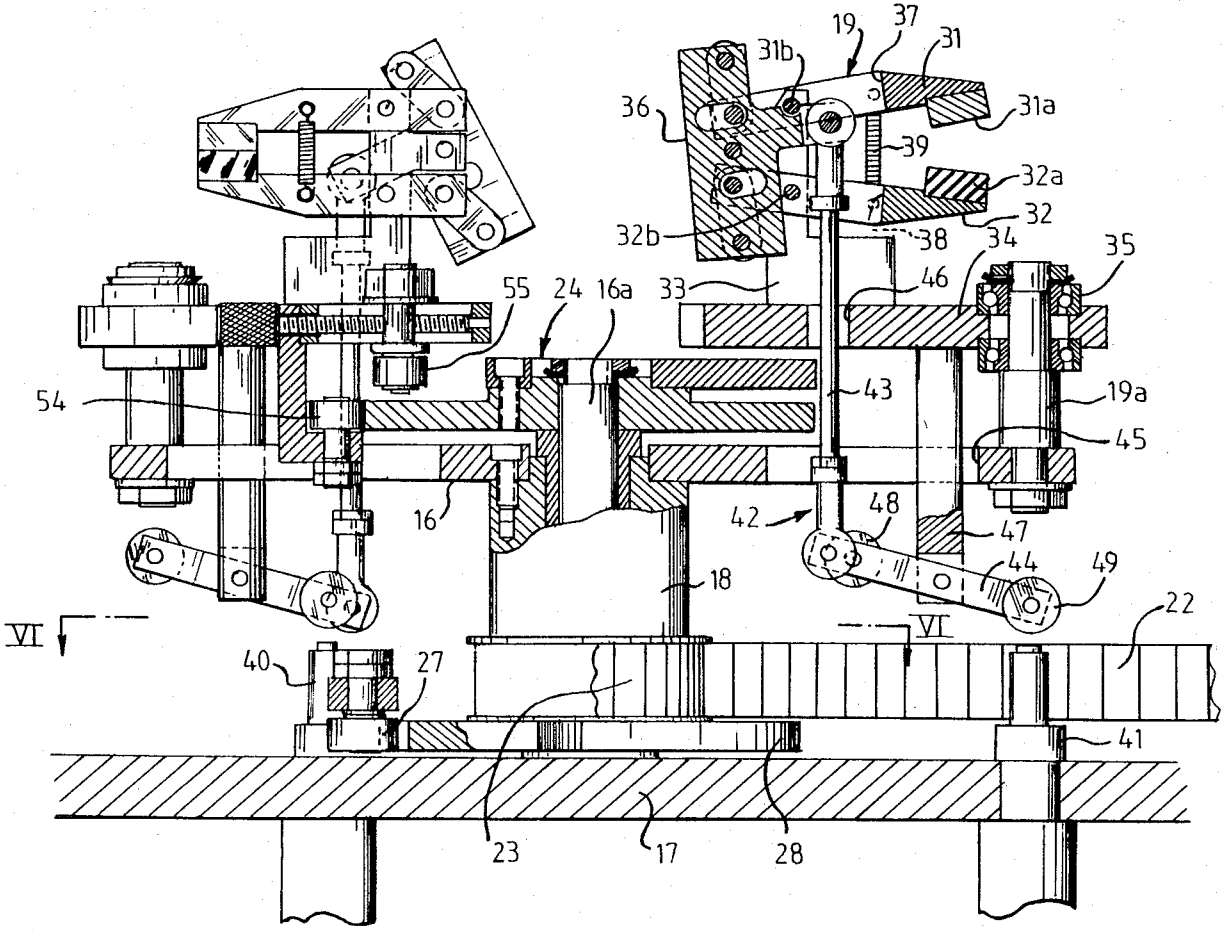
FIG. 4 is a sectional view of this transfer device along the broken line IV—IV of FIG. 3.

As shown in FIG. 4, this actuating mechanism 42 comprises a vertical link 43 and a rocking lever 44 hinged end to end. Link 43 passes through two openings 45 and 46 formed respectively in table 16 and the support plate 34 and is hinged to the connection 30. Lever 44 is supported at its center by a rod 47 lowered from support plates 34, so as to be able to pivot in a vertical plane perpendicular to the hinge pins 31*b* and 32*b* of the jaws of the nippers. Lever 44 further has at each of its ends a roller 48, 49. The opening 40 and closing 41 actuators are positioned so as to be located respectively just below the inner roller 48 of lever 44 when nipper 17 is in its third position P3 and just below its outer roller 49 when the nipper is in its first position P1.

Thus, when the nipper is in position $P_3$ opposite the rolling up post 8, the opening actuator 40 is actuated so as to push link 43 upwards by rocking lever 44 in one direction. Link 43 then acts on the hinged connection 36 against the return force of springs 39 for bringing it to its inoperative position, shown on the right hand part of FIG. 4, and thus moving the jaws away from each other so as to free the foil which they are carrying. Nipper 19 is held open until it reaches its first position P1.

A short time after the nipper has been immobilized in position P1, the closing actuator 41 is actuated in its turn so as to cause lever 44 to rock in the other direction and to draw link 43 downwards which thus frees the connection 36 from its inoperative position. The two jaws 31 and 32 are thus urged against each other so as to grip therebetween the foil blank B, and the nipper is held closed until it again reaches its third position P3.

The orientation mechanism 24, which has been mentioned above, is formed of two cams 51 and 52 integral secured to shaft 16*a* of the rotary table 16 and extending one above the other. The lower cam 51 is a circular cam centered about shaft 16*a* whereas the upper cam 52 is a substantially elliptical cam off-centered with respect to this shaft.

Each of nippers 17 has, in a lateral extension 53 of its support plate 34, two rollers 54 and 55 for cooperating respectively with the circular cam 51 and the elliptical cam 52.

The first roller 54 is fixed, whereas the second roller 55 is mounted for movement parallel to the axis of symmetry of nipper 19, between the first roller 54 and the elliptical cam 52. Positioning of the second roller 55 is provided along an aperture 56 formed in the lateral extension 53 by an endless screw 57, having a knurled wheel 58 and immobilization thereof in the chosen position is provided by means of a clamping screw 59.

Considering the direction of rotation X of the rotary table 16 (see FIG. 3), the two rollers 54, 55 are disposed upstream of the line connecting together the rotational shaft 16*a* of this latter and the pivoting shaft 19*a* of the nipper which supports them. Furthermore, during rotation of table 16, each nipper is held in engagement with one or other of cams 51 or 52 by a spring 60 which bears on a stud 61 fixed to table 16.

Figure 5:
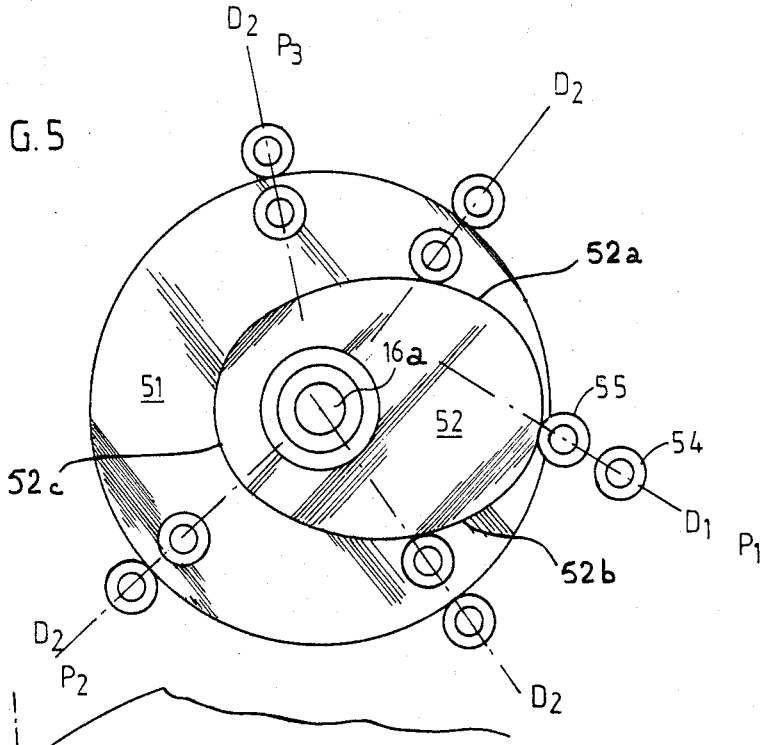
FIG. 5 is a top view showing the orientation mechanism of this transfer device.

As can be clearly seen in FIG. 5, the guiding edge of the elliptical cam 52 is formed by three curvilinear sections 52*a*, 52*b* and 52*c*. Section 52*a* which covers the path of nippers 19 between positions P3 and P1, defines a curve which moves gradually away from the shaft 16*a* of the rotary table 16. Section 52*b* which covers the path of nippers 19 between positions P1 and P2 defines on the contrary a curve which draws gradually nearer to this shaft. The form of the third section 52 is of no importance.

The operation of the cam orientation mechanism 24 is as follows.

When a given nipper 19 is in its first position P1, its second roller 55 is applied against the elliptical cam 52, at the connecting point of its two sections 52*a* and 52*b*, the nipper then being positioned in a first orientation D1. During the first angular rotation of table 16, roller 55 rolls along the second guide section 52*b* of cam 52, so that the nipper pivots until the first roller 54 is applied against the circular cam 51 (see FIG. 5). The nipper is thus, in a first step, positioned in a second orientation D2.

Then, the second roller 55 moves away from the elliptical cam 52 and the first roller 54 rolls along the circular cam 51 until the second roller 55 is again applied against the elliptical cam 52 (see FIG. 5).

The nipper 19 is thus maintained in its orientation D2 during this second step, and more especially when it is in its second and third positions P2 and P3.

Finally, in a third step, the second roller rolls along the first guide section 52*a* of cam 52 for causing nipper 19 to pivot in the other direction and placing it again in its first orientation D1 in its first position P1.

By modifying the position of the second roller 55 through the adjusting screw 57, the starting orientation D1 of nipper 19 can be varied and thus the angle through which this latter pivots for reaching orientation D2. Thus, there is provided a simple means for modifying the orientation of the blanks under the cutting knife of the finishing cutting out post, depending on the conicity it is desired to give to the finished caps. It should be noted that, with this adjusting means, orientation D2 of the nipper opposite the finishing cutting out and rolling up posts is invariable whatever the conicity of the caps so that the front edge of the foils is always applied along a generatrix of the rolling up sleeve.

I claim:

1. An installation for manufacturing, from flexible foils, hollow truncated cone shaped articles and in particular caps for wine bottles with a widened neck, this installation comprising a pre-cutting out post (2) where foil blanks (B) are cut out in succession from a continuous strip (A), a finishing cutting out post (4) where foils (C) having the final required dimensions are produced from these blanks, a rolling up post (8) where each of these foils is rolled on a respective truncazted cone shaped sleeve (7) of a device (5) for shaping hollow articles, adapted to be driven with a stepped rotational movement, and a transfer device (3) which moves the foil blanks one by one between the pre-cutting out post (2) and the finishing cutting out post (4), then brings the foils from this latter to the rolling up post (8), this installation being characterized in that the transfer device comprises at least one gripping member (19) mounted for pivoting about a first axis (19*a*) on a support (16) which is itself adapted to be moved in synchronism with the stepped rotation of the shaping device (5), by three successive angular steps per revolution about a second axis (16*a*) with respect to which the precutting out (2), finishing cutting out (4) and rolling up (8) posts of the installation are centered, so that between the three angular rotations of its support, the gripping member (19) is immobilized successively in a first position (P1) in which it grasps a foil blank opposite the pre-cutting out post (2), a second position (P2) in which it presents this blank under the finishing cutting out post (4) and a third position (P3) in which it releases the cut out foil opposite the rolling up post (8), the transfer device (3) further comprising a mechanism (24) for orientating the gripping member (19) for causing it to pivot through a preset angle about the said first axis (19*a*), between its first and its second positions (P1, P2), then holding it as far as its third position (P3) in the orientation which it has in its second position (P2) and placing it again in its first position (P1) in its starting orientation and means for adjusting the starting orientation of the gripping member (19) depending on the conicity to be given to the finished hollow articles.

2. The installation according to claim 1, characterized in that the transfer device (3) comprises three gripping members (19) centered about the second axis (16*a*) and angularly equidistant from each other, their support being formed by a rotary table (16) mounted for rotation about the second axis (16*a*) and movable angularly through three successive steps of 120° per revolution, each corresponding to a rotational step of the shaping device (5).

3. The installation according to claim 2, characterized in that the orientation mechanism (24) comprises two fixed superimposed cams (51,52), along one or other of which each gripping member (19) is, during rotation of the rotary support (16), guided by a set of two rollers (54,55) one of which is adjustable in position, these two cams (51,52) combining their actions to cause each gripping member (19) to pivot through said preset angle, in one direction between its first and second positions (P1,P2), and in the other direction between its third and its first positions (P3,P1) and for holding it in a constant orientation between its second and its third positions (P2,P3).

4. The installation according to claim 3, characterized in that the two cams (51,52) are fixed to the rotational shaft (16*a*) of the rotary support (16), one of these cams (51) being circular and centered about this shaft (16*a*) whereas the second (52) has a guide edge which moves away from this shaft (16*a*) over a first section (52*a*) covering the path of each gripping member (19) between its third and its first position (P3,P1) and which draws near thereto over a second section (52*b*) which covers this path between the first and second positions (P1, P2), of the gripping member, in that each gripping member (19) has a first fixed roller (54) for cooperating with the first cam (51) and a second roller adjustable in position (55) for cooperating with the second cam (52) and situated between this latter and the first roller (54), the second roller (55) rolling over a part at least of the first and second guide sections (52*a* and 52*b*) of the second cam (52) for causing the corresponding gripping member (19) to pivot through said preset angle in one direction and in the other whereas the first roller (54) bears against the first cam (51) as soon as the second roller (55) is disengaged from the second cam (52) for holding the gripping member (19) in a constant orientation, and in that the means for adjusting the starting orientation of the gripping member is formed by a member for positioning each of the second rollers (5).

5. The installation according to claim 4, characterized in that said positioning member is formed by an endless screw (57) having a knurled wheel (58) which guides the second roller (55) inside an aperture (56) formed in a lateral extension of a support plate (34) supporting the gripping member (19) and which is associated with a clamping nut (59) for immobilizing the second roller (55) in any position along this aperture (56).

6. The installation according to claim 5, characterized in that each gripping member (19) is formed by a nipper which opens outwardly of the support (16) and which, under the control of an actuating mechanism (42) is closed a short time after being immobilized in its first position (P1) and is only opened once it has stopped in its third position (P3).

7. The installation according to claim 6, characterized in that each nipper (19) comprises two jaws (31,32) both hinged to a nipper body (33) and connected together, on one side of their hinge pins (31*b*,32*b*), by a hinged connection (36) forming a deformable parallelogram and, on the other side, by two paired springs (39) and in that said actuating mechanism is connected to the hinged connection (36) for placing it, under the action of an opening actuator (40) in its inoperative position in which the two jaws (31,32) are moved away from each other and, under the action of a closing actuator (41), releasing it from this inoperative position and allowing the springs (39) to urge the two jaws against each other.

8. The installation according to claim 7, characterized in that one of the jaws (31) has a metal clamping heel (31*a*) whereas the other jaw (32) has a rubber clamping heel (32*a*).

9. The installation according to claim 8, characterized in that the transfer device (3) further comprises a stop mechanism (25,27,29) for instantaneously immobilizing the support (16) of the gripping members between two successive angular rotations.

* * * * *